US010688557B2

(12) United States Patent
Lee et al.

(10) Patent No.: US 10,688,557 B2
(45) Date of Patent: Jun. 23, 2020

(54) FLAKE-LIKE FINE PARTICLES

(71) Applicant: TOKUSEN KOGYO CO., LTD., Hyogo (JP)

(72) Inventors: Woojin Lee, Hyogo (JP); Shun Wakasaki, Hyogo (JP); Takayuki Kanamori, Hyogo (JP)

(73) Assignee: TOKUSEN KOGYO CO., LTD., Ono, Hyogo (JP)

( * ) Notice: Subject to any disclaimer, the term of this patent is extended or adjusted under 35 U.S.C. 154(b) by 616 days.

(21) Appl. No.: 14/766,616

(22) PCT Filed: Dec. 3, 2013

(86) PCT No.: PCT/JP2013/082461
§ 371 (c)(1),
(2) Date: Aug. 7, 2015

(87) PCT Pub. No.: WO2014/155834
PCT Pub. Date: Oct. 2, 2014

(65) Prior Publication Data

US 2016/0001362 A1 Jan. 7, 2016

(30) Foreign Application Priority Data

Mar. 29, 2013 (JP) ..... 2013-071901

(51) Int. Cl.
*B22F 1/00* (2006.01)
*H01B 1/02* (2006.01)
*B22F 9/30* (2006.01)
*H01B 1/22* (2006.01)

(52) U.S. Cl.
CPC ..... *B22F 1/0055* (2013.01); *B22F 1/0074* (2013.01); *B22F 9/30* (2013.01); *H01B 1/02* (2013.01); *H01B 1/22* (2013.01)

(58) Field of Classification Search
None
See application file for complete search history.

(56) References Cited

U.S. PATENT DOCUMENTS

| | | | | |
|---|---|---|---|---|
| 6,454,847 | B1 | 9/2002 | Iri et al. | |
| 2006/0137488 | A1 | 6/2006 | Sakaue et al. | |
| 2009/0252924 | A1* | 10/2009 | Kamikoriyama | C09D 11/52 428/141 |
| 2012/0174824 | A1 | 7/2012 | Takenaka et al. | |
| 2012/0280187 | A1 | 11/2012 | Kim et al. | |
| 2015/0104625 | A1* | 4/2015 | Shiozawa | B22F 1/0055 428/208 |
| 2015/0252224 | A1* | 9/2015 | Iseda | C08K 3/08 428/323 |

FOREIGN PATENT DOCUMENTS

| | | | | |
|---|---|---|---|---|
| EP | 1857205 | A1 | | 11/2007 |
| JP | S46-29271 | | | 8/1971 |
| JP | 2003-147270 | | | 5/2003 |
| JP | 2005240013 | | * | 9/2005 |
| JP | 2006-63414 | | | 3/2006 |
| JP | 2006-111903 | A | | 4/2006 |
| JP | 2008-202076 | | | 9/2008 |
| JP | 2008202076 | | * | 9/2008 |
| JP | 2009-013449 | A | | 1/2009 |
| JP | 2012052198 | A | * | 3/2012 |
| JP | 2012052198 | A | * | 3/2012 |
| JP | 2014-111057 | A | | 6/2014 |
| WO | 99/54074 | | | 10/1999 |
| WO | 2011/024407 | | | 3/2011 |
| WO | WO 2015/060173 | A1 | | 4/2015 |
| WO | WO 2015060173 | | * | 4/2015 |

OTHER PUBLICATIONS

Nemai et al. Chipless and Conventional Radio Frequency Identification: Systems for Ubiquitous Tagging. Monash University, IGI Global, pp. 187-189, 2012 (Year: 2012).*
Cotterell. Fracture and Life. World Scientific, Imperial College Press, p. 390, 2010 (Year: 2010).*
Roughness measurements of stainless steel surfaces. Euro Inox 2014, pp. 1-7 (Year: 2014).*
International Search Report for PCT/JP2013/082461, dated Jan. 14, 2014, and English translation thereof.
Notice of Reasons for Refusal, dated Jun. 3, 2015, in related JP Application No. 2013-071901, and English translation thereof.
Duan et al., "Facile Synthesis and Formation Mechanism of Silver Nanoplates with Edge Lengths of Several Micrometers", Acta Physico-Chimica Sinica, 2009, 25(7), pp. 1405-1408.
Notification of Reexamination dated Jul. 11. 2018, which issued in the corresponding Chinese Patent Application No. 201380074937.7, including English translation.
Chinese Office Action from Chinese Appeal Board dated Oct. 9, 2018, which issued in the corresponding Chinese Patent Application No. 201380074937.7, including English translation.
N1PL1: Journal of Xi and Polytechnic University, vol. 23, No. 4, pp. 5-7.
N1PL2: Rare Metal Materials and Engineering, vol. 37, No. 4, Apr. 2008, pp. 8-11.

* cited by examiner

*Primary Examiner* — Tanisha Diggs
(74) *Attorney, Agent, or Firm* — Dickinson Wright PLLC

(57) ABSTRACT

[Object] To provide fine particles 2 having excellent printing characteristics, thermal conductivity, and electrical conductivity.
[Solution] The fine particles 2 are flake-like. A main component of the fine particles 2 is an electrically conductive metal. A representative metal is silver. The structure of this metal is monocrystalline. An arithmetical mean roughness Ra of the surface of the fine particles 2 is not larger than 10 nm. The fine particles 2, a solvent, a binder, and a dispersant, etc., are mixed to obtain an electrically conductive paste. By using the electrically conductive paste, a pattern connecting elements is printed on a printed circuit board of an electronic device.

3 Claims, 5 Drawing Sheets

FLAKE-LIKE FINE PARTICLES

TECHNICAL FIELD

The present invention relates to fine particles that are flake-like and whose main component is a metal.

BACKGROUND ART

An electrically conductive paste is used for manufacturing a printed circuit board of an electronic device. The paste contains fine particles whose main component is a metal (i.e., fine metal particles), a binder, and a liquid organic compound (solvent). By using the paste, a pattern connecting elements is printed. The paste is heated after printing. As a result of heating, fine metal particles are sintered together with other adjacent fine metal particles.

Since the pattern is obtained through printing, excellent printing characteristics are necessary for the paste. Since the paste is to be heated, excellent thermal conductivity is necessary for the paste. Since the pattern is a passage for electrons, excellent electrical conductivity is also necessary for the paste. In order to obtain these characteristics, extremely small particles (so-called nano particles) are used for the paste. The particles are flake-like. A representative material of the particles is silver.

JP2006-63414 discloses flake-like particles whose material is silver. The particles are formed through processing of spherical particles using a ball mill.

CITATION LIST

Patent Literature

Patent Literature 1: JP2006-63414

SUMMARY OF THE INVENTION

Problems to be Solved by the Invention

Printing characteristics, thermal conductivity, and electrical conductivity of conventional fine metal particles are not sufficient. An object of the present invention is to improve printing characteristics, thermal conductivity, and electrical conductivity of fine particles.

Solution to the Problems

Fine particles according to the present invention are flake-like. A main component of the fine particles is a metal. An arithmetical mean roughness Ra of the surface of the fine particles is not larger than 10 nm.

Preferably, the main component of the fine particles is silver. Preferably, a metal structure of the main component is monocrystalline.

A powder according to the present invention includes multiple fine particles that are flake-like and whose main component is a metal. An arithmetical mean roughness Ra of the powder is not larger than 10 nm.

Preferably, a median size (D50) of the powder is not smaller than 0.1 μm but not larger than 20 μm. Preferably, a standard deviation σD of diameter D of the powder is not larger than 10 μm. Preferably, an average thickness Tave of the powder is not smaller than 1 nm but not larger than 100 nm. Preferably, an aspect ratio (D50/Tave) of the powder is not lower than 20 but not higher than 1000.

An electrically conductive paste according to the present invention includes:

(1) multiple fine particles that are flake-like, whose main component is a metal, and whose surface has an arithmetical mean roughness Ra of not larger than 10 nm; and (2) a solvent.

Advantageous Effects of the Invention

The fine particles according to the present invention have an arithmetical mean roughness Ra of not larger than 10 nm. In other words, the surface of the fine particles is smooth. The fine particles are superior in slidability. Thus, aggregation of a plurality of fine particles is suppressed. In a paste, the fine particles disperse sufficiently. The paste containing the fine particles is superior in printing characteristics.

The surface of the fine particles having an arithmetical mean roughness Ra of not larger than 10 nm is smooth and also flat. In the paste after printing, the fine particles overlap with each other with a large contact surface area. Thus, the paste shows a high thermal conductivity when being heated. With the paste, sintering is achieved through heating for a short period of time. With the paste, sintering is achieved through heating at a low temperature.

In a pattern after sintering, the fine particles overlap with each other with a large contact surface area. Thus, the pattern can easily conduct electricity. The fine particles are also superior in electrical conductivity.

DESCRIPTION OF EMBODIMENTS

The following will describe in detail the present invention based on preferred embodiments with reference to the accompanying drawing.

Figure 1:
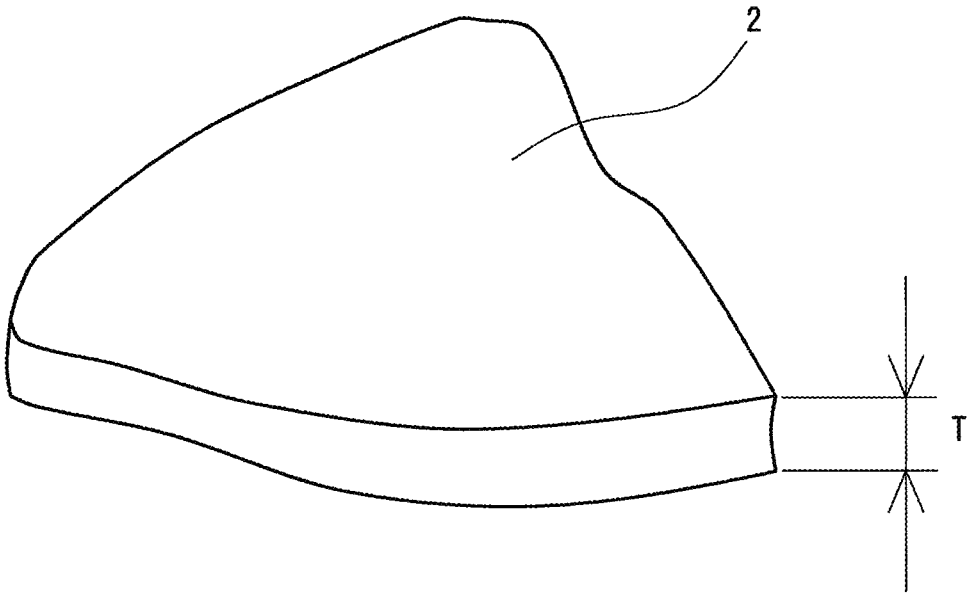
FIG. 1 is a perspective view showing fine particles according to one embodiment of the present invention.

FIG. 1 shows fine particles 2. The fine particles 2 are flake-like. A main component of the fine particles 2 is an electrically conductive metal. The fine particles 2 are so-called nano flakes. The fine particles 2 are one element of a powder.

A representative use application of the fine particles 2 is an electrically conductive paste. A large number of the fine particles 2, a solvent, a binder, and a dispersant, etc., are mixed to obtain the electrically conductive paste.

An arithmetical mean roughness Ra of the surface of the fine particles 2 is not larger than 10 nm. The surface of the fine particles 2 is smooth. The fine particles 2 are superior in slidability. Thus, aggregation of a plurality of the fine particles 2 is suppressed. In the paste, the fine particles 2 disperse sufficiently. The paste containing the fine particles 2 is superior in printing characteristics.

The surface of the fine particles 2 having the arithmetical mean roughness Ra of not larger than 10 nm is smooth and also flat. In the paste after printing, the fine particles 2 overlap with each other with a large contact surface area. Thus, the paste shows a high thermal conductivity when being heated. With the paste, sintering can be achieved through heating for a short period of time. With the paste, sintering can be achieved through heat at a low temperature.

In a pattern after sintering, the fine particles 2 overlap with each other with a large contact surface area. Thus, the pattern can easily conduct electricity. The fine particles 2 are also superior in electrical conductivity.

From a standpoint of printing characteristics, thermal conductivity, and electrical conductivity, the arithmetical mean roughness Ra is more preferably not larger than 8.0 nm and particularly preferably not larger than 3.5 nm. From a standpoint of ease of manufacturing, the arithmetical mean roughness Ra is preferably not smaller than 1.0 nm.

The arithmetical mean roughness Ra is measured using an atomic force microscope (AFM). The AFM is a type of scanning probe microscope. The AFM includes a cantilever and a probe attached to the tip of the cantilever. The probe scans the surface of the fine particles 2. The cantilever is displaced in the vertical direction by a force acting between atoms of a sample and the probe. The displacement is measured. Based on the result of the measurement, the arithmetical mean roughness Ra of the fine particles 2 is calculated.

In the present invention, "SPM-9600" from Shimadzu Corporation is used as the AFM. Conditions for the measurement are described below.

Mode: Contact mode

Cantilever: OMCL-TR800PSA-1 from Olympus Corporation

Resolution: 512×512 pixels

Height direction resolution: 0.01 nm

Horizontal direction resolution: 0.2 nm

The flattest surface is selected in each of the fine particles 2, and the arithmetical mean roughness Ra is measured using this surface. The distance in which a measurement is conducted is 2 μm. When measurement within the distance of 2 μm is difficult at the flattest surface, the measurement is conducted within a largest possible distance on the flat surface.

The fine particles 2 whose metal structure of the main component is monocrystalline are preferable. With the fine particles 2, a small arithmetical mean roughness Ra can be achieved. The fine particles 2 are superior in printing characteristics, electrical conductivity, and thermal conductivity.

In the present invention, an arithmetical mean roughness Ra is measured in each of 10 particles randomly extracted from the powder. The 10 roughnesses Ra are averaged. The average is the roughness Ra as the powder. The average is preferably not larger than 10 nm, more preferably not larger than 8.0 nm, and particularly preferably not larger than 3.5 nm. The average is preferably not smaller than 1.0 nm.

A median size (D50) of the powder is preferably not smaller than 0.1 μm but not larger than 20 μm. The powder whose median size (D50) is not smaller than 0.1 μm can be easily manufactured. From this standpoint, the median size (D50) is more preferably not smaller than 0.5 μm and particularly preferably not smaller than 1.0 μm. The powder whose median size (D50) is not larger than 20 μm is superior in printing characteristics and electrical conductivity. From this standpoint, the median size (D50) is more preferably not larger than 15 μm and particularly preferably not larger than 8 μm. The median size (D50) is measured using a laser diffraction type particle size analyzer (LA-950V2) from HORIBA, Ltd.

The standard deviation σD of diameter D of the powder is preferably not larger than 10 μm. The powder whose standard deviation σD is not larger than 10 μm is superior in printing characteristics and electrical conductivity. From this standpoint, the standard deviation σD is more preferably not larger than 8 μm and particularly preferably not larger than 4 μm.

An average thickness Tave of the powder is preferably not smaller than 1 nm but not larger than 100 nm. The powder whose average thickness Tave is not smaller than 1 nm can be easily manufactured. From this standpoint, the average thickness Tave is more preferably not smaller than 10 nm and particularly preferably not smaller than 20 nm. The powder whose average thickness Tave is not larger than 100 nm is superior in electrical conductivity. From this standpoint, the average thickness Tave is more preferably not larger than 80 nm and particularly preferably not larger than 50 nm. The average thickness Tave is calculated by averaging a thickness T (see FIG. 1) of 100 of the fine particles 2 randomly extracted. Each thickness T is visually measured based on an SEM picture.

An aspect ratio (D50/Tave) of the powder is preferably not lower than 20 but not higher than 1000. The powder whose aspect ratio (D50/Tave) is not lower than 20 is superior in electrical conductivity and thermal conductivity. From this standpoint, the aspect ratio (D50/Tave) is preferably not lower than 30 and particularly preferably not lower than 35. The powder whose aspect ratio (D50/Tave) is not higher than 1000 can be easily manufactured. From this standpoint, the aspect ratio (D50/Tave) is more preferably not higher than 500 and particularly preferably not higher than 100.

In the following, one example of a method for manufacturing the fine particles 2 whose main component is silver will be described. In this manufacturing method, a silver compound is dispersed in a liquid that is a carrier by a dispersant. A representative silver compound is silver oxalate. Silver oxalate can be obtained through a reaction of a solution of the silver compound which is a material, and an oxalate compound. Impurities are removed from a precipitate obtained from the reaction to obtain a powder of silver oxalate.

From a standpoint of having less adverse effect on the environment, a hydrophilic liquid is used as the carrier. Specific examples of a preferable carrier include water and alcohols. The boiling points of water and alcohols are low. Dispersion liquids in which water and alcohols are used can easily achieve high pressure. Preferable alcohols are ethyl alcohol, methyl alcohol, and propyl alcohol. Two or more types of liquids may be used in combination for the carrier.

Silver oxalate does not substantially dissolve in the carrier. Silver oxalate is dispersed in the carrier. The dispersion can be enhanced through ultrasonic wave treatment. The dispersion can be enhanced also with a dispersant.

The dispersion liquid, in a state of being pressurized by compressed air, is heated while being stirred. As a result of the heating, a reaction shown in the following formula occurs. In other words, silver oxalate decomposes by heat.

$$Ag_2C_2O_4=2Ag+2CO_2$$

Within the dispersion liquid, silver precipitates as particles. An organic compound derived from silver oxalate, the carrier, or the dispersant adheres to the surface of the silver particles. This organic compound is chemically bound to the silver particles. In other words, the fine particles 2 include silver and the organic compound. The main component of the fine particles 2 is silver. With respect to the mass of the fine particles 2, the mass of silver accounts for preferably not less than 99.0%, and particularly preferably not less than 99.5%. It is not necessary to have the fine particles 2 include the organic compound.

Means for obtaining the fine particles 2 whose surface has an arithmetical mean roughness Ra of not larger than 10 nm include:

(1) setting the concentration of silver oxalate in the dispersion liquid within a predetermined range, (2) using a specific dispersant, (3) setting the pressure upon heating within a predetermined range, and (4) setting the stirring speed within a predetermined range, etc.

The concentration of silver oxalate in the dispersion liquid is preferably not lower than 0.1 M but not higher than 1.0 M. From the dispersion liquid in which the concentration is within the above described range, a powder having a small particle size distribution can be obtained. In addition, from the dispersion liquid, a powder having a small arithmetical mean roughness Ra can be obtained. From these standpoints, the concentration is particularly preferably not lower than 0.2 M but not higher than 0.7 M.

A preferable dispersant is a glycol based dispersant. From a dispersion liquid containing the glycol based dispersant, a powder having a small particle size distribution can be obtained. From the dispersion liquid, a powder having a small arithmetical mean roughness Ra can be obtained. From the dispersion liquid, a powder having a high aspect ratio (D50/Tave) can be obtained. Furthermore, a powder produced from the dispersion liquid disperses sufficiently in the solvent. A particularly preferable dispersant is polyethylene glycol.

The pressure of an environment during the decomposition reaction of silver oxalate is preferably higher than atmospheric pressure. As a result of the decomposition reaction in the environment, a powder having a small particle size distribution can be obtained. Furthermore, as a result of the decomposition reaction in the environment, a powder having a small arithmetical mean roughness Ra can be obtained. From these standpoints, the pressure is preferably not lower than 2 $kgf/cm^2$. The pressure is preferably not higher than 10 $kgf/cm^2$.

The stirring speed when conducting the decomposition reaction of silver oxalate is preferably not lower than 100 rpm. With a level of stirring at a speed of not lower than 100 rpm, aggregation of the fine particles 2 with each other is suppressed. Thus, a powder having a small particle size distribution can be obtained. Furthermore, with a level of stirring at a speed of not lower than 100 rpm, a powder having a high aspect ratio (D50/Tave) can be obtained. From these standpoints, the stirring speed is preferably 130 rpm. The stirring speed is preferably not higher than 1000 rpm.

The temperature of the dispersion liquid when conducting the decomposition reaction of silver oxalate is preferably not lower than 100° C. In a dispersion liquid not colder than 100° C., the reaction is completed in a short period of time. From this standpoint, the temperature is particularly preferably not lower than 120° C. From a standpoint of energy cost, the temperature is preferably not higher than 150° C.

As described above, a large number of the fine particles 2 and a solvent etc., are mixed to obtain the electrically conductive paste. Examples of the solvent include: alcohols such as aliphatic alcohols, alicyclic alcohols, aromatic-aliphatic alcohols, and polyhydric alcohols; glycol ethers such as (poly)alkylene glycol monoalkyl ethers and (poly) alkylene glycol monoaryl ethers; glycol esters such as (poly)alkylene glycol acetates; glycol ether esters such as (poly)alkylene glycol monoalkyl ether acetates; hydrocarbons such as aliphatic hydrocarbons and aromatic hydrocarbons; esters; ethers such as tetrahydrofuran and diethyl ether; and amides such as dimethylformamide (DMF), dimethylacetamide (DMAC), and N-methyl-2-pyrrolidone (NMP). Two or more types of solvents may be used in combination.

The main component of the fine particles 2 may be a metal other than silver. Examples of the metal other than silver include gold, copper, zinc oxide, and titanium oxide.

EXAMPLES

The following will show the effects of the present invention by means of Examples, but the present invention should not be construed in a limited manner based on the description of these Examples.

Example 1

A first solution was obtained by dissolving 50 g of silver nitrate in 1 L of distilled water. On the other hand, a second solution was obtained by dissolving 22.2 g of oxalic acid in 1 L of distilled water. A mixture containing silver oxalate was obtained by mixing the first solution and the second solution. Impurities were removed from this mixture. 3 g of polyethylene glycol (dispersant) was added to 1 L of the mixture, and the mixture was stirred for 30 minutes while having ultrasonic waves applied thereon. With this, silver oxalate was dispersed. The mixture was placed in an autoclave. The mixture was pressurized at a pressure of 0.5 MPa. The mixture was heated to 150° C. while being stirred at a speed of 150 rpm. The stirring was conducted for 30 minutes at this temperature to obtain a liquid containing fine particles whose main component is silver. An average of the arithmetical mean roughness Ra of the fine particles was 3.5 nm.

Example 2

A liquid containing fine particles was obtained in a manner similar to that in Example 1, except for setting the temperature during the reaction at 120° C., and setting the stirring speed during the reaction at 120 rpm.

Example 3

A liquid containing fine particles was obtained in a manner similar to that in Example 1, except for not applying pressure before the reaction, setting the temperature during the reaction at 120° C., and setting the stirring speed during the reaction at 110 rpm.

Comparative Example 1

A liquid containing fine particles was obtained in a manner similar to that in Example 1, except for using polyvinyl pyrrolidone as the dispersant, not applying pressure before the reaction, setting the temperature during the reaction at 130° C., and setting the stirring speed during the reaction at 120 rpm.

Comparative Example 2

Spherical fine particles consisting of silver were processed into a flake-like shape using a ball mill. The arithmetical mean roughness Ra of the particles after the process was 30 nm.

Evaluation of Electrical Conductivity

Multiple fine particles, a binder, and a dispersant were mixed to obtain an electrically conductive paste. Wiring was printed by using the electrically conductive paste. The wiring was kept for 1 hour at a temperature of 220° C. to sinter the particles with each other. Electrical resistivity of the wiring was measured. The results are shown in the following Table 1.

TABLE 1

Figure 2:
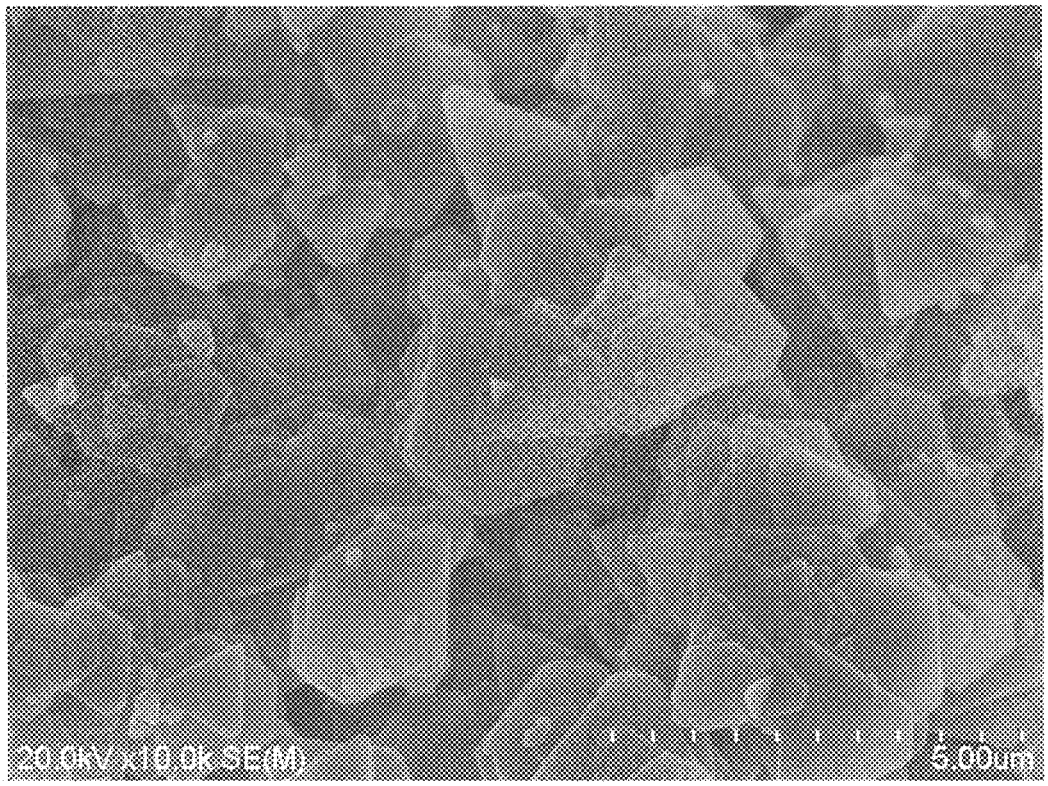
FIG. 2 is a microscope picture showing fine particles according to Example 1 of the present invention.
Figure 3:
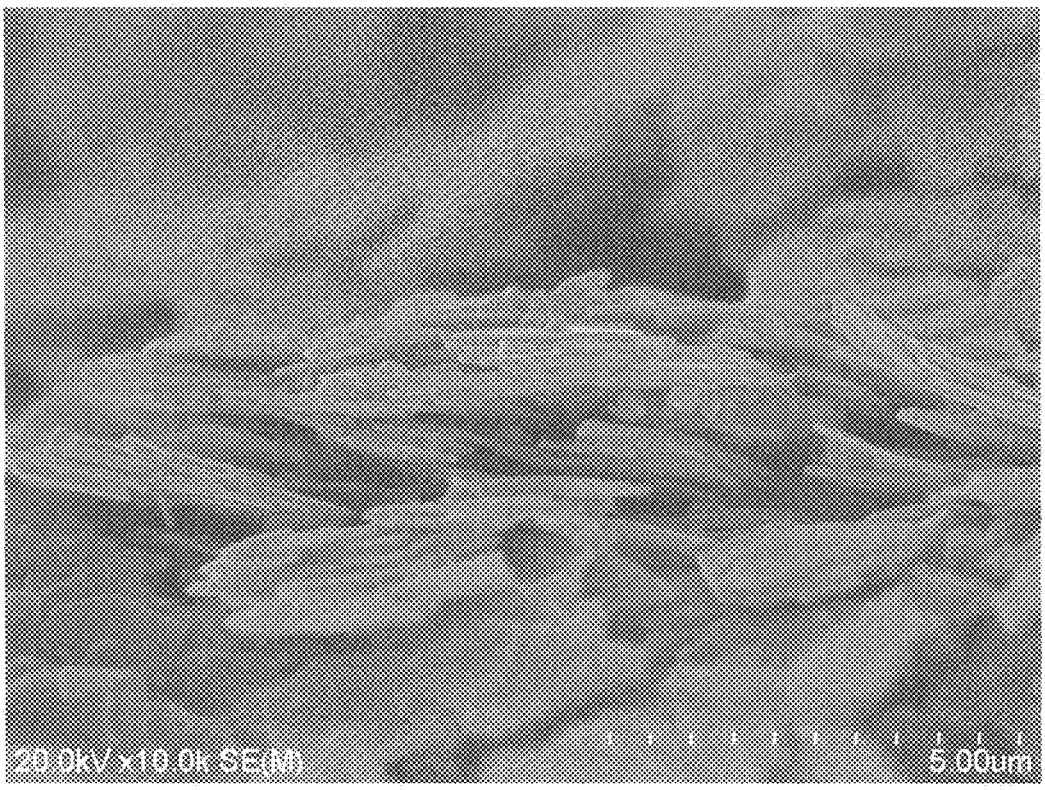
FIG. 3 is a microscope picture showing the fine particles according to Example 1 of the present invention.
Figure 4:
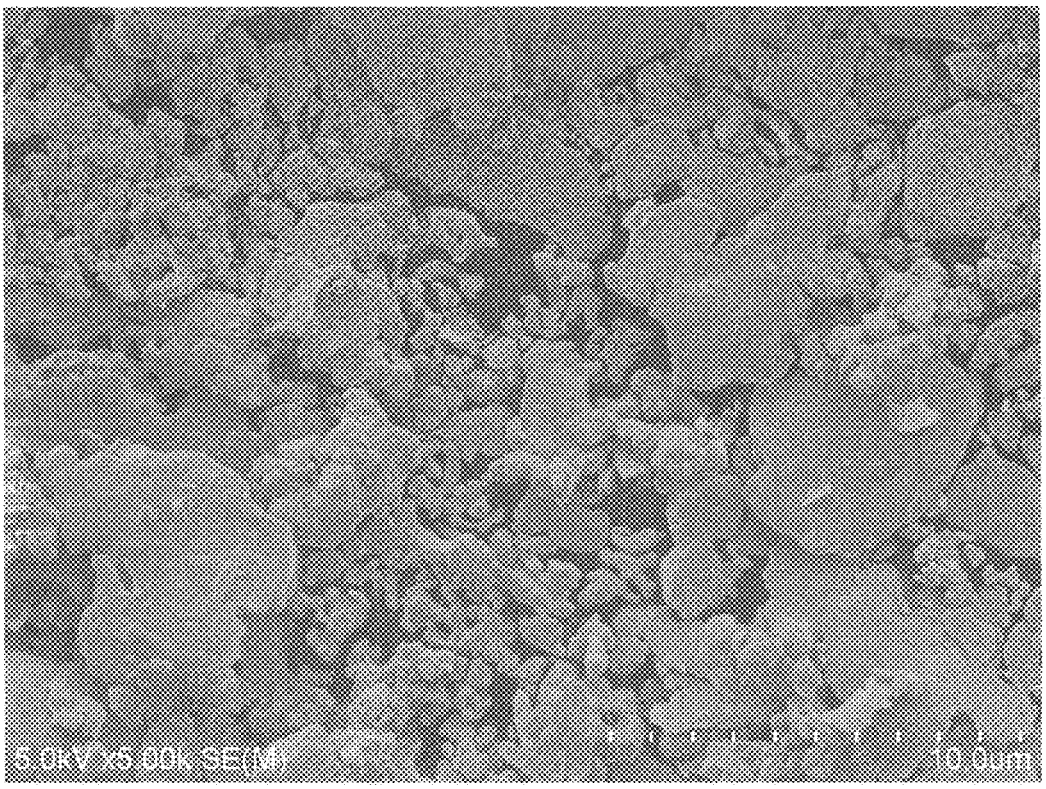
FIG. 4 is a microscope picture showing fine particles according to Comparative Example 2 of the present invention.
Figure 5:
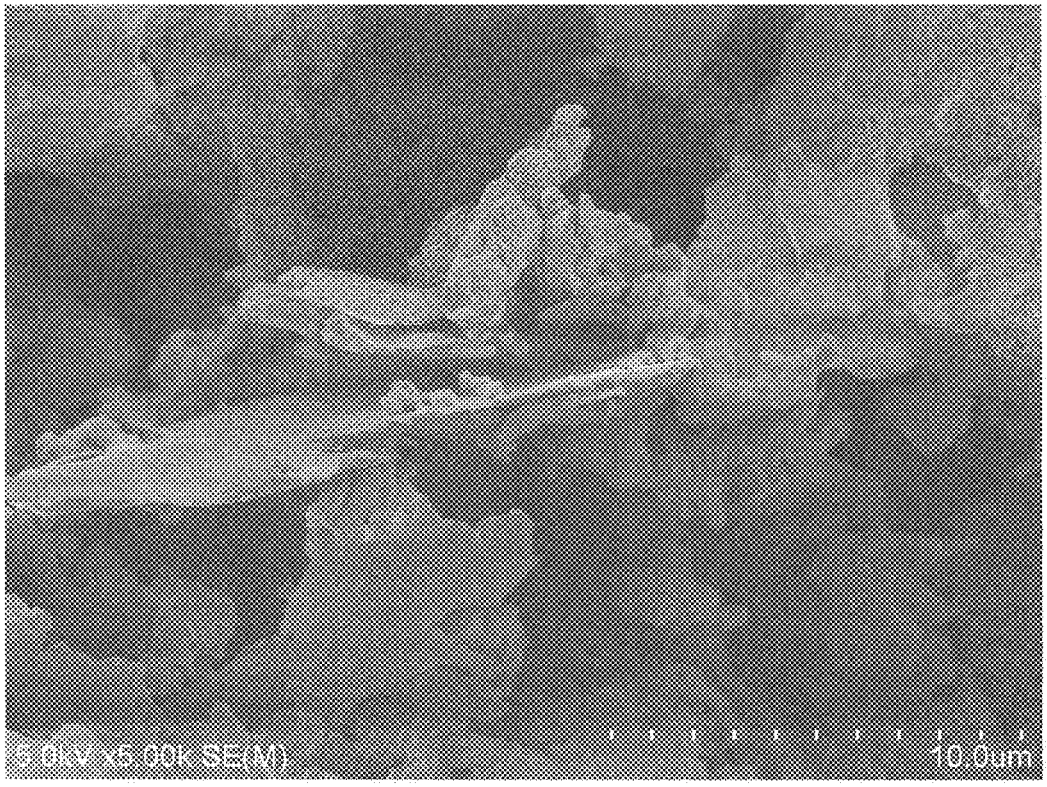
FIG. 5 is a microscope picture showing the fine particles according to Comparative Example 2 of the present invention.

| Evaluation Result | | | | | |
|---|---|---|---|---|---|
| | Example 1 | Example 2 | Example 3 | Comparative Example 1 | Comparative Example 2 |
| Average of Ra (nm) | 3.5 | 8.0 | 9.5 | 18 | 30 |
| Median Size D50 (μm) | 2 | 8 | 15 | 14 | 10 |
| Standard Deviation σD (μm) | 1 | 4 | 8 | 7 | 10 |
| Average Thickness Tave (nm) | 50 | 20 | 95 | 90 | 250 |
| D50/Tave | 40 | 400 | 158 | 156 | 40 |
| Picture (plane) | FIG. 2 | — | — | — | FIG. 4 |
| Picture (lateral surface) | FIG. 3 | — | — | — | FIG. 5 |
| Electrical Resistivity (μΩ · cm) | 4.2 | 4.8 | 5.7 | 10.2 | 12.5 |

As shown in Table 1, the wiring obtained from the fine particles of each of the Examples was superior in electrical conductivity. The advantage of the present invention is obvious from the evaluation result.

INDUSTRIAL APPLICABILITY

The fine particles according to the present invention can be used for a paste for printed circuits, a paste for electromagnetic wave shielding films, a paste for electrically conductive adhesive, and a paste for die bonding, etc.

DESCRIPTION OF THE REFERENCE CHARACTERS

2 . . . fine particle

The invention claimed is:

1. An electrically conductive paste comprising:

(1) fine particles that are flake-like, whose main component is silver, and whose surface has an arithmetical mean roughness Ra of not larger than 8 nm, a median size (D50) of the particles is 2-8 μm, and an average thickness Tave of the particles of 20-50 nm, and where a metal structure of the main component is monocrystalline; and (2) a solvent.

2. The electrically conductive paste according to claim 1, wherein a standard deviation σD of diameter D of the particles is not larger than 10 μm.

3. The electrically conductive paste according to claim 1, wherein an aspect ratio (D50/Tave) of the particles is not lower than 20 but not higher than 1000.

* * * * *